US010888891B2

(12) United States Patent
Gaskin et al.

(10) Patent No.: US 10,888,891 B2
(45) Date of Patent: Jan. 12, 2021

(54) ATOMISER ASSEMBLY

(71) Applicant: The James Hutton Institute, Dundee (GB)

(72) Inventors: Graham Gaskin, Dundee (GB); Stephen John Hillier, Dundee (GB)

(73) Assignee: THE JAMES HUTTON INSTITUTE, Dundee (GB)

( * ) Notice: Subject to any disclaimer, the term of this patent is extended or adjusted under 35 U.S.C. 154(b) by 275 days.

(21) Appl. No.: 15/760,462

(22) PCT Filed: Sep. 16, 2016

(86) PCT No.: PCT/GB2016/052900
§ 371 (c)(1),
(2) Date: Mar. 15, 2018

(87) PCT Pub. No.: WO2017/046607
PCT Pub. Date: Mar. 23, 2017

(65) Prior Publication Data

US 2018/0353988 A1 Dec. 13, 2018

(30) Foreign Application Priority Data

Sep. 17, 2015 (GB) ..... 1516492.4

(51) Int. Cl.
*B05B 17/06* (2006.01)
*B06B 1/02* (2006.01)

(52) U.S. Cl.
CPC ..... *B05B 17/0676* (2013.01); *B05B 17/0623* (2013.01); *B05B 17/0653* (2013.01);
(Continued)

(58) Field of Classification Search
CPC ..... B05B 17/0676; B05B 17/0623
See application file for complete search history.

(56) References Cited

U.S. PATENT DOCUMENTS 4,138,687 A 2/1979 Cha et al.
4,930,700 A * 6/1990 McKown ..... B05B 17/0623 239/102.2

(Continued)

FOREIGN PATENT DOCUMENTS

EP 0217518 A1 4/1987
EP 0568936 A1 11/1993
GB 955405 4/1964

OTHER PUBLICATIONS

Search Report for GB1516492.4 dated Oct. 30, 2015, 3 pages.

(Continued)

*Primary Examiner* — Leith S Shafi
*Assistant Examiner* — Nicholas R Krasnow
(74) *Attorney, Agent, or Firm* — Husch Blackwell LLP

(57) ABSTRACT

A compact apparatus for atomisation of fluid samples comprises a sonotrode (11), placed so that an ultrasonic wave emitted by the sonotrode is directed through a channel (25) in a separate channel device (21) and reflected by from the interface (26) in a high-low impedance transition zone (Tz), so that a standing wave is formed within the channel. A positive air flow through the channel, driven by a pressure differential at each end of the channel, interacts with the working fluid or slurry being delivered by a fluid delivery device (30) to atomise it. The speed of the air flow and the dispersal, homogeneity, and size of particles in the slurry sample can be controlled by varying the shape of the channel outlet.

19 Claims, 4 Drawing Sheets

(52) U.S. Cl.
CPC ..... *B05B 17/0669* (2013.01); *B06B 1/0238* (2013.01); *B06B 2201/77* (2013.01)

(56) References Cited

U.S. PATENT DOCUMENTS

| | | | | |
|---|---|---|---|---|
| 6,656,391 | B1 * | 12/2003 | Bonnerot | G21C 3/623 252/643 |
| 9,156,015 | B2 * | 10/2015 | Shen | B01F 15/065 |
| 10,300,443 | B2 * | 5/2019 | Friesen | B01J 2/04 |
| 2002/0099292 | A1 * | 7/2002 | Brisken | A61B 8/12 600/466 |
| 2006/0005766 | A1 | 1/2006 | Gorges et al. | |
| 2007/0017441 | A1 | 1/2007 | Stauch et al. | |
| 2008/0156320 | A1 * | 7/2008 | Low | A61M 11/005 128/200.16 |
| 2011/0042481 | A1 * | 2/2011 | Kanamori | C02F 1/46104 239/102.1 |
| 2011/0147482 | A1 * | 6/2011 | Matsuura | B01D 1/20 239/102.1 |
| 2011/0239973 | A1 * | 10/2011 | Qin | C10L 1/1817 123/1 A |
| 2012/0037232 | A1 * | 2/2012 | Shen | B01F 13/1027 137/1 |
| 2013/0161407 | A1 * | 6/2013 | Hielscher | B05B 17/0607 239/4 |
| 2015/0069146 | A1 * | 3/2015 | Lowy | B05B 15/58 239/102.2 |
| 2017/0333861 | A1 * | 11/2017 | Friesen | B01J 2/04 |
| 2018/0104618 | A1 * | 4/2018 | Fonseca | A61P 37/02 |
| 2018/0343812 | A1 * | 12/2018 | Leo | F02C 3/04 |
| 2019/0038994 | A1 * | 2/2019 | Beetz | B05B 1/00 |
| 2019/0232305 | A1 * | 8/2019 | Beetz | B05B 5/032 |

OTHER PUBLICATIONS

International Search Report for PCT/GB2016/052900 dated Jan. 13, 2017, 6 pages.
Written Opinion for PCT/GB2016/052900 dated Jan. 13, 2017, 8 pages.
Sollner K., Trans Faraday Soc 32 (1936) 1537-1538.
Peskin R L, Raco R J, J. Acoust Soc Am 35 (1963) 1378-1381.
Beyer, R T., J. Acoust Soc Am 63(4) (1978) 1025-1030.
Groschl M., Acustica Acta Acustica 84 (1998) 432-447.
Kauczor C, Frohleke N., IEEE Power Electronics Specialists Conference. IEEE 35th Annual (2004) 4, 2736-2741.
Andersen O, Hansmann S, Bauckhage K., Particle and Particle Systems Characterisation 13 (1996) 217-223.
Reipschlager O, Bothe H-J, Warnecke B, Monien B, Pruss J, Weigand B., University of Paderborn. ILASS-Europe 2002.
Sadayuki Ueha, Yoshiki Hashimoto, Yoshikazu Koike, Ultrasonics 38 (2000) 26-32.
Boa-Teh Chu, Robert Apfel, J. Acoust Soc Am. 72(6) (1982) 1673-1687.

* cited by examiner

ATOMISER ASSEMBLY

The present invention relates to an atomiser assembly, particularly an ultrasonic standing wave atomiser assembly.

BACKGROUND TO THE INVENTION

Atomisers are used for the dispersion of particles in a fluid such as a gas, for example the generation of a spray or aerosol, being a dispersion of solid or liquid particles in a gas fluid. Atomisers are well known, and are used for a wide variety of different purposes, for example spraying of coatings or preparation of samples for laboratory or industrial use, delivery of medications from nebulisers etc.

Ultrasonic atomisers are known. With some known ultrasound atomisers, a working fluid is passed through an axial channel of a cylindrical horn or sonotrode which emits ultrasonic waves generated by an ultrasonic transducer, which can for example be a magnetic or piezo-ceramic element. The fluid leaves the axial channel at the free end of the sonotrode where it is broken up into fine droplets.

Ultrasonic standing wave (USVV) atomisers are also known, in which the working fluid does not come into direct contact with the vibrating part of the sonotrode, but is broken up by the action of an acoustic standing wave field formed in an air space. The references US2007/0017441 and *Inverter topologies for ultrasonic piezoelectric transducers with high mechanical Q-factor* (Kauczor C, Frohleke N. IEEE Power Electronics Specialists Conference. IEEE 35th Annual (2004) 4, 2736-2741) describe examples of this type, useful for understanding the invention. These disclosures are incorporated herein by reference. The standing wave is produced by arranging a rigid reflector parallel to the active surface of the sonotrode and separated from it by a distance which will cause the reflected acoustic energy to be in phase with that radiated. This distance will generally be a multiple of $\lambda/2$ where $\lambda=v_c/f$, $v_c$ being the speed of sound and f the frequency of oscillation. Points with high acoustic energy levels are formed at the standing wave pressure nodes and, with sufficient incident ultrasonic energy, liquids introduced into these areas will be broken up into droplets. Because of difficulties experienced with the atomised product contaminating the reflector, modifications have been made to this method to increase the distance over which the standing wave is produced by using two sonotrodes facing each other and operating at similar frequencies. The above references contain examples of such devices, as do the papers: *Production of fine particles from melts of metals or highly viscous fluids by Ultrasonic Standing Wave Atomisation* (Anderson O, Hansmann S, Bauckhage K. Particle and Particle Systems Characterisation 13 (1996) 217-223) and *Modelling and simulation of the disintegration process in Ultrasonic Standing Wave Atomisation* (Reipschlager O, Bothe H-J, Warnecke B, Monien B, Pruss J, Weigand B. ILASS-Europe 2002) which are also useful for understanding the invention, and which are incorporated herein by reference.

SUMMARY OF THE INVENTION

According to the invention there is provided an atomiser assembly comprising an energy generator configured to emit an energy wave, a channel device comprising a channel having a channel inlet to admit the energy wave from the energy generator into the channel, and a channel outlet configured to emit the energy wave generated by the energy generator, and a fluid delivery device having a fluid outlet arranged adjacent to the channel outlet, wherein the displacement between the energy generator and the channel outlet approaches a multiple of $n(\lambda/4)$ where n is an odd number, and wherein a standing wave is established within the channel.

The fluid delivery device is configured to deliver the fluid to be atomised, and may comprise a fluid reservoir.

The channel optionally comprises internal channel walls, wherein the walls are parallel. The channel can optionally be a cylindrical bore, with an internal channel wall. The bore can optionally be straight and have parallel sides. Other shapes of bore can alternatively be used.

Optionally, the channel device comprises more than one channel. Optionally, where this is the case, each channel is the same length, and optionally the same width or diameter. Optionally the channels are formed from the same material. Optionally, at least one channel differs in at least one of length, width, diameter, or material from at least one other channel.

The energy generator optionally generates a wave with a planar wavefront, optionally by moving an active face of the energy generator axially. The wave optionally travels in a direction parallel to the axis of the channel. The axis of the energy generator is optionally aligned with the axis of the channel. The wave emerging from the channel outlet optionally has a planar wavefront. The wave passing through the channel optionally propagates as a planar wavefront travelling in a direction in alignment with the axis of the channel. While it is useful for the wave passing through the channel to be propagating entirely parallel to the axis of the channel, this is in practice unnecessary, as some parts of the wavefront may optionally be diverging at least by a small angle.

The displacement between the energy generator (optionally the active face of the energy generator) and the channel outlet is a function of the wavelength ($\lambda$) of the wave, wherein the displacement approaches $n(\lambda/4)$ where n is an odd number.

Optionally the channel device comprises a plate having opposite inlet and outlet surfaces on which the channel inlet and channel outlet are respectively disposed. Optionally the inlet and outlet surfaces of the plate are mutually parallel, so that the plane of the channel inlet is parallel to the plane of the channel outlet. Optionally the plate is metal, and the inlet and outlet surfaces are flat. Optionally the plate is formed or manufactured in one section. Optionally the plate comprises several sections, optionally all made of the same material, optionally made of different material. Optionally the segments are fixed together, for example by threaded fixings, welding, bayonet-type fixings, or other fixing means, to form the plate. Optionally, when threaded fixings are used, at least one section of the plate is recessed such that the head of the threaded fixing is substantially level with or flush with the face of the plate, and thus do not protrude.

A segmented plate offers the advantage that the plate may be disassembled for cleaning, thus reducing the risks of, for example, cross-contamination of samples.

Optionally the channel device is disposed in close proximity to a face of the energy generator from which the energy wave is emitted. Optionally the face of the energy generator which emits the energy wave (the active face) comprises a solid:gas interface of the energy generator. Optionally the inlet surface of the channel device is disposed within 1 mm of the active face of the energy generator. Optionally the face of the energy generator which emits the energy wave is disposed within a recess in the plate.

Optionally, the channel is disposed parallel to the axis of the energy wave emitted from the energy generator, and optionally coaxial with the axis of the energy wave and coaxial with the axis of the energy generator. Optionally, the channel is disposed perpendicular to the active face of the energy generator. Optionally, the inlet and outlet faces of the channel device are disposed parallel to the active face of the energy generator.

Optionally, the channel device is separate from the energy generator, and is optionally separated therefrom. Optionally, the inlet face of the channel device bearing the channel inlet is separated from the active face of the energy generator. Optionally, the inlet face and the active face are separated by a gap, optionally filled by a medium which can be a fluid such as air or another gas in order that a positive acoustic radiation pressure is developed between these faces. Optionally the positive acoustic radiation pressure sets up a positive flow of the medium through the channel device, e.g. from the channel inlet to the channel outlet. Optionally, the standing wave within the channel gives rise to a pressure differential across the channel in an axial direction. Optionally the standing wave produces a region of high pressure at one of the inlet or the outlet of the channel, and a region of low pressure at the other of the inlet or the outlet of the channel. Optionally, the separation between the inlet face of the channel device on the active face of the energy generator approaches 0.35 mm when air is used as the medium. Good results can be obtained within a range of approximately 0.1 to 1 mm, for example 0.2 to 0.5 mm, and optionally in the present examples, within a range of 0.25 mm to 0.4 mm. Other separation distances between the inlet face of the channel device and active face of the energy generator can be used where a gas other than air is used or in other examples of the invention. The separation between the inlet face of the channel device and the active face of the energy generator is optionally a trade-off between the need to generate sufficient radiation pressure at the active face to move air through the channel (the radiation pressure increases according to the inverse square law, as suggested by equation 3 in reference 9), and the need to space the channel from the active face by a sufficient distance to permit a sufficient airflow at the inlet surface of the channel device to transmit the energy through the channel. Useful separations can vary with the area of the active face available at the periphery of the channel inlet. A suitable separation can be derived in other cases as a function of $h.r^2$ where h is the separation and r is the radius of the channel.

Optionally, the energy wave is a sound wave, optionally an ultrasound wave. Optionally, the energy generator is an ultrasonic wave generator such as a sonotrode, configured to generate ultrasonic energy waves. Optionally, the frequency of the energy wave is consistent, and can be selected as a constant or substantially constant value in a range of frequencies from 20 kHz to 70 kHz. Optionally, the amplitude of the sonotrode vibrations can be measured in μm, for example from 10 to 150 μm. Different amplitudes of the wave can be used in different examples of the atomiser, as can different frequencies.

The present invention also provides a method of generating a dispersion of particles using an atomiser device, the atomiser device comprising an energy generator configured to emit an energy wave, a channel device having a channel with a channel inlet to admit the energy wave from the energy generator into the channel and a channel outlet configured to emit the energy wave generated by the energy generator, and a fluid delivery device having a fluid outlet, the method comprising passing an energy wave through the channel, flowing fluid through the fluid delivery device, and discharging fluid from the fluid outlet into the energy wave emitted from the channel outlet, the method further comprising axially separating the channel outlet from the energy generator by a distance approaching $n(\lambda/4)$ where n is an odd number, including establishing a standing wave in the energy wave within the channel.

The dispersion of particles can optionally be an aerosol or spray. The particles can optionally be solid or liquid. The particles can optionally be dispersed in the fluid. Optionally the particles can be suspended in the fluid. The fluid can optionally be a liquid when discharged from the fluid outlet, and can optionally be atomised into a dispersion of particles by the energy wave.

Passing the energy wave through the channel and emitting the energy wave from the channel outlet optionally creates a transition zone having an acoustic impedance gradient (which can be steep) at the interface between the medium (in this case a fluid such as a gas) inside the channel, which optionally has a relatively low impedance, and the medium outside the channel outlet, which optionally has a relatively higher impedance than the medium inside the channel. The transition zone boundary with a peak gradient from low to high impedance optionally forms a wave-reflective barrier that reflects the energy wave travelling from the channel inlet to the channel outlet back into the channel towards the energy generator, i.e. in the opposite direction to the wave passing through the channel from the inlet to the outlet. The reflected wave is changed in phase by 180 degrees relative to the energy wave emitted from the channel outlet. The transition zone boundary creates the standing wave within the channel.

Optionally, negative reflection of the energy wave by the transition zone boundary may coincide with and/or contribute to the formation of a torus-shaped region of low pressure around the exterior of the channel outlet. The formation of the torus is believed to be caused by the formation of the standing wave in the channel, and the torus is most pronounced when the displacement between the energy generator and the channel outlet approaches $n(\lambda/4)$ where n=1, more so than when n=3, and is not seen where the displacement approaches a multiple of $n(\lambda/4)$ where n is an even number. As the medium is optionally at higher pressure outside this region of low pressure, it may optionally flow towards the region of low pressure. The flow of the medium towards the region of low pressure is more pronounced in certain other examples of the invention, optionally when the channel outlet has a tapered external profile, optionally a nozzle, optionally with the diameter of the taper decreasing in an axial direction, optionally away from the sonotrode.

Where the channel outlet has a tapered external profile, optionally the medium surrounding the outlet moves towards the low pressure torus and up the tapered walls. The taper optionally acts to direct the flow of the medium towards the stream of medium already exiting the channel outlet. Increasing the angle of the taper increases the vector of the medium as it is drawn towards the outlet. The taper thus optionally entrains the flow of the medium, which optionally produces a powerful jet effect away from the channel outlet.

The powerful jet of medium may be advantageous, for example where the fluid that is being delivered to the apparatus is to be used for spray coating a surface as described in more detail below.

Optionally, this powerful jet effect can be minimised by using a non-tapered external profile with the surface of the plate at the channel outlet being perpendicular to the channel external walls, and optionally in or near the same plane as the channel outlet. Where a planar plate surface is optionally used, provided that the spacing between the active face of the sonotrode and the channel outlet is very close or equal to n(λ/4) (where n is an odd number), the torus of low pressure continues to be formed around the exterior of the channel outlet. The jet effect is optionally reduced by the flow of medium being drawn to the torus from all directions. The medium is not focussed in any given direction, and may therefore optionally meet and combine to reduce or cancel out the velocity of medium being drawn in from opposing directions.

Optionally, the fluid outlet is disposed within the transition zone, and optionally can be positioned as close as possible to the transition zone boundary, formed at the boundary between the low impedance region within the channel, and the high impedance region outside the outlet of the channel, typically where the impedance gradient is peaking. The transition zone boundary can extend outwardly from the outlet face of the channel device in the region of the channel outlet in a partial sphere or cone, away from the planar surface of the outlet face, optionally with the axis of the channel at the centre, the base of the sphere or cone of the transition zone boundary at the outlet face having the same or a similar radius as the channel outlet. The axis of the channel optionally passes through the centre of the sphere or cone of the transition zone. The impedance gradient is optionally highest at the boundary of the transition zone at the edge of the channel outlet at or near to the outlet face of the channel device, so higher energies can be transmitted to the fluid as the fluid outlet approaches the outlet face and the edge of the channel outlet. The fluid outlet is optionally disposed at an axial location relative to the axis of the channel which is closer (e.g. in a direction along the axis of the channel) to a pressure node than to an antinode of the wave. Optionally, the fluid outlet is disposed at or near to a pressure node on the standing wave. Although we do not wish to be bound by theory, we postulate that in some cases, there may be an 'end effect', where because the air is not massless, inertia causes a slight delay in axial expansion at the channel outlet, and the channel may therefore behave acoustically as though it were longer than its physical length. This effect can have increased significance with larger outlet sizes. According to Rayleigh (1896), the end effect for larger diameters can be about 0.2×radius.

Optionally, the fluid outlet is spaced radially from the axis of the channel, and is closer to axial alignment with a peripheral boundary of the channel, such as the channel wall, than it is to the axis of the channel. Optionally, the fluid outlet is disposed adjacent to or at the transition zone boundary created outside the channel, optionally at or adjacent to a wall of the channel, or other peripheral boundary of the channel. Arranging the fluid outlet at or adjacent to the transition zone boundary optionally discharges the fluid from the fluid outlet into a higher energy part of the transition zone, and in certain examples, the atomisation of the fluid upon discharge from the fluid outlet can be enhanced. Higher energy dissipation of the fluid into a dispersion might be more effective for high viscosity fluids.

In other options, the fluid outlet can be disposed radially closer to the axis of the channel. This might be more useful for enhanced homogeneity of the spray in certain cases.

Accordingly, in different examples of the invention, a transition zone having an acoustic impedance gradient at the interface between the interior of the channel and the exterior of the channel is created at the channel outlet, and the fluid outlet is optionally disposed within the transition zone.

Acoustic energy from the sonotrode thus optionally travels through the channel, and because the acoustic impedance within the channel is lower than that in the unconstrained air outside the channel, a reflection of the incident energy takes place at the channel outlet, optionally by reflecting from the interface between low and high impedance established within the transition zone at the channel outlet. The reflected wave undergoes a phase change of 180 degrees relative to the wave emitted from the channel outlet. Reflection of the incident energy travelling through the channel from the energy generator thus optionally reflects back into the channel as a reflected wave. Choosing a displacement of the channel outlet from the active face of the sonotrode of n(λ/4), where n is odd, creates a particularly beneficial reinforcing reflection, hence forming a standing wave within the channel, optionally with a pressure node at or adjacent to the channel outlet. Discharging the fluid from the fluid outlet of the fluid delivery device at or near this node is particularly beneficial because at the node, the velocity of both the incident and the reflected waves are at a maximum and have different vectors, so that liquids or suspensions discharged from the fluid outlet into this part of the wave absorb large amounts of energy from the incident and reflected waves and the liquids or suspensions are atomised with high efficacy and efficiency.

Optionally, the internal dimensions and structure of the channel are arranged to create or enhance or increase the acoustic impedance gradient at the channel outlet. Optionally, the channel can be cylindrical, but in other examples of the invention, different internal structures of the channel can be contemplated. Optionally, the diameter of the channel can be selected in order to create or enhance the acoustic impedance gradient at the channel outlet. For example, for a typical energy wave having a frequency of 20 kHz and generated by a sonotrode having a face amplitude of 120 μm, a suitable diameter can be obtained by adopting a diameter to length ratio of approximately 0.7, but acceptable examples can range from, for example 0.5 to 0.8. Diameters within this range can be useful in producing a more focussed boundary between high and low impedance in the transition zone. Higher ratios, with larger diameters for a given length, can lead to a reduction in the impedance gradient in the transition zone, and hence a lower energy of reflection. Lower ratios, with a smaller diameter for a given length, can lead to a reduction in the transmission of energy from the energy generator through the channel, from the inlet to the outlet. In some cases, ratios outwith these ranges can be used for particular types of fluids.

The method and apparatus of the invention can optionally be used for spray drying of particles, for example particles in suspension.

In another aspect of the invention, the plate through which the channel passes comprises an annular recessed chamber, which optionally surrounds the channel, and which optionally opens onto the outlet surface of the plate, the opening of the chamber on the outlet surface providing an outlet for the chamber, the chamber outlet optionally being co-axial with the channel. Optionally the opening on the plate surface forming the chamber outlet is the same shape as the channel outlet, optionally with a consistent spacing between the channel outlet and the chamber outlet. The size of the spacing between the chamber outlet and the channel outlet may be varied to suit the qualities of the fluid being dispersed, for example, it may be larger for more viscous fluids. The plane of the chamber outlet is optionally spaced axially from the plane of the channel outlet, optionally by a distance sufficient to accommodate or disrupt the torus shaped region of low pressure. In one example, at least a part of the torus is disposed axially between the chamber outlet and the channel outlet. Optionally the torus does not protrude beyond the chamber outlet.

Optionally the fluid flows from the chamber outlet, optionally into the energy wave passing through the channel. Optionally at least one wall (for example an inner wall) of the annular chamber is tapered. Optionally the tapered wall is radially spaced from the channel outlet. Optionally the tapered wall tapers towards the channel outlet such that the radius of the annular chamber decreases along the axis of the channel in a direction towards the channel outlet, but the inner surface of the tapered wall is optionally still radially spaced from the outer wall of the channel at the outlet of the chamber on the outlet surface of the plate. The tapered end of the annular chamber optionally focusses and/or directs the flow of the fluid flowing through the chamber outlet towards and optionally into the low pressure torus extending around the circumference of the channel outlet before flowing across the channel outlet. Optionally the fluid flows, optionally through capillary action, along the tapered wall of the annular chamber. Optionally the fluid flows at least partially by capillary action towards the region of low pressure, optionally with no additional pressure or force being applied. Optionally the fluid is injected into the fluid delivery device. Optionally the flow rate of the fluid is restricted, optionally to control the dispersal of the optionally atomised or optionally aerosolised fluid once it flows across the channel outlet and is energised by the energy wave at the channel outlet. Optionally an end (e.g. the outlet) of the annular chamber extends axially beyond the channel outlet. Optionally the extended end is tapered, optionally tapered such that the diameter of the end of the annular chamber decreases as it extends axially away from the channel outlet. Optionally this reduces or avoids the jet effect of the medium flowing towards the low pressure torus around the channel outlet, as optionally when an end, optionally the outlet, of the annular chamber extends axially beyond the channel outlet, the toroidal region of low pressure continues to be formed around the exterior of the channel outlet as before. Optionally, this results in the torus being contained within at least a portion of the axially extended section of the annular chamber. The portion of the annular chamber in which the torus optionally is contained optionally acts to screen the low pressure torus from the external medium, optionally reducing or avoiding flow of medium towards the low pressure torus. As flow of the medium is optionally not being induced by the presence of a region of low pressure, the jet effect is reduced or eliminated.

The jet effect acting to propel the atomised fluid away from the end of the channel can be useful in some examples. For example, when applying a spray coating, it can be useful to accelerate the atomised fluid as quickly as possible away from the atomiser assembly to convey the atomised fluid onto surface being coated or treated. However, in some other examples, the jet effect interferes with the desired results, and so in some examples, e.g. in spray drying, the momentum of the atomised particles is desirably kept as low as possible after generation of the aerosol, so that the dried particulate material disperses into a controllable volume. In such cases, where the jet effect is to be reduced or avoided, optionally the end of the annular chamber extends beyond the channel outlet, for example, by a distance in the range of 0.1-0.5 mm, optionally within the range of 0.1 mm-0.3 mm. In the presently-described embodiment, a distance of 0.19 mm was found to be effective, offering more homogenous particle sizes, improved atomisation, and allowing a greater feed rate of fluid, as well as easier recovery of the spray dried material from a manageable volume of container. This offers the advantage that the apparatus can be made more compact in size. This spacing dimension may vary dependent on the qualities and optionally on the rheological properties of the fluid being sampled and dispersed, as well as the dimensions of the channel and other aspects of the structure.

Optionally the plate comprises a radial bore that extends from the exterior of the plate into the annular chamber, optionally in a radial direction, optionally perpendicular to the channel. Optionally fluid is flowed or injected into the bore, and optionally exits into the annular chamber. Optionally the fluid discharges from the annular chamber into the energy wave at the channel outlet, optionally into a pressure node at or adjacent to the channel outlet.

As described above, discharging the fluid from the fluid outlet of the fluid delivery device at or near this node is particularly beneficial because, we believe, at the node, the velocity of both the incident and the reflected waves are at a maximum and have different vectors, so that liquids or suspensions discharged from the fluid outlet into this part of the wave absorb large amounts of energy from the incident and reflected waves and the liquids or suspensions are atomised with high efficacy and efficiency. Without wishing to be bound by theory, it is believed that most of the atomisation occurs in the fluid as it crosses the channel outlet and is energised by the energy wave in the channel. However, perturbation of the fluid as it crosses the boundaries of the torus shaped low pressure area may also contribute to the atomisation.

Also according to the present invention, there is provided a method of spray drying a particulate substance in the form a slurry of the particulate substance suspended in a fluid, the method comprising generating a dispersion of particles from the slurry according to the method as substantially hereinbefore described, and drying the dispersion of particles.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee.

DETAILED DESCRIPTION OF AT LEAST ONE EXAMPLE OF THE INVENTION

Figure 1:
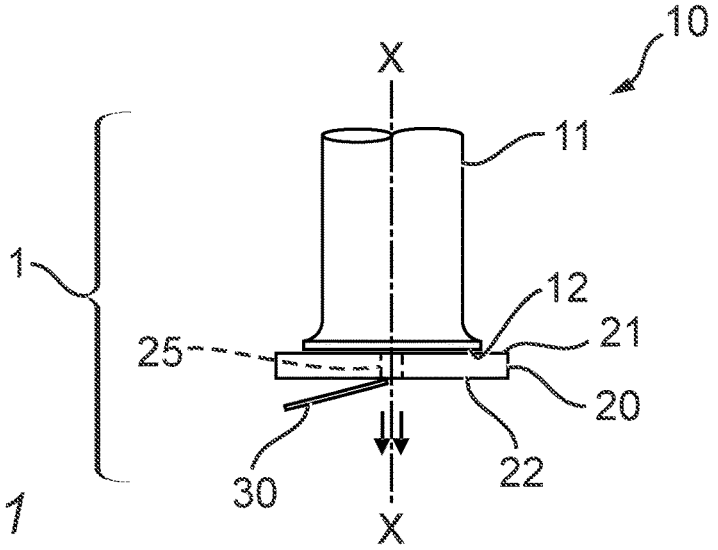
FIG. 1 shows a schematic side view of an atomiser assembly.

Referring now to the drawings, an atomiser assembly 1 has an energy generator 10 which in this example comprises an ultrasonic transducer (in this case, a Model CL334 by Qsonica of Newtown Conn., USA driven by a model Q700 generator also by Qsonica, although other examples can use the AFG-2105 function generator, by GW Instek of Taipei, Taiwan, and a P200 linear amplifier, by FLC Electronics of Partille, Sweden) fitted with a sonotrode 11 designed to amplify the ultrasonic energy wave emitted by the ultrasonic transducer. The nominal sonotrode energy wave has an amplitude of 120 μm at a frequency of 20 kHz. Operating in air, under these parameters, the wavelength of the wave emitted from the sonotrode is provided by the equation $\lambda=v_c/f$, where $v_c$ is the speed of sound in air (340 m/s) and f is the frequency of oscillation (20 kHz in the case of this transducer) hence λ in this example=17 mm. The sonotrode 11 is generally cylindrical with a long axis x-x, and has a flat active face 12 at one end, with a flared edge. The energy generator comprising the ultrasonic transducer and sonotrode 11 is optionally mounted on a frame (not shown) adjacent to a channel device which in this example comprises a metal plate. In this example, the channel device comprises an aluminium plate 20 arranged parallel to the sonotrode's flat active face, but spaced therefrom and held in the spaced relationship by the frame. An optional linear bearing assembly on the frame (not shown) allows μm adjustment of the air gap separating the sonotrode 11 and the plate 20.

Figure 2:
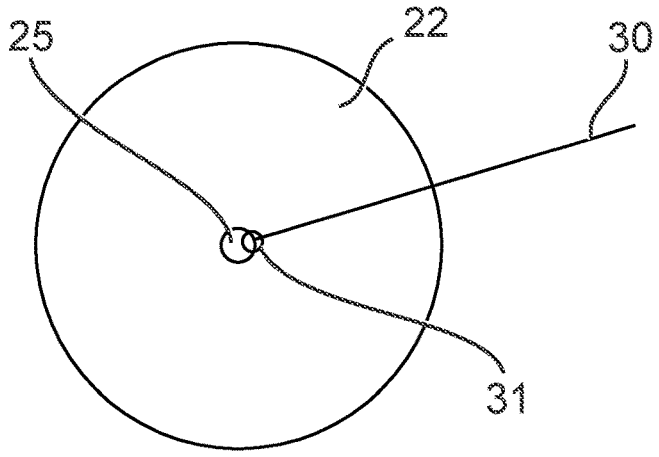
FIG. 2 shows an end view of the atomiser assembly of FIG. 1.

The plate 20 has a channel 25 extending from a channel inlet located on an inlet face 21 of the plate 20, to a channel outlet located on an outlet face 22 of the plate 20. The channel 25 extending between the channel inlet and the channel outlet is typically straight, and is aligned with the axis x-x of the sonotrode 11, as the inlet face 21 of the plate 20 is parallel to the active face of the sonotrode 11. In this example, the channel 25 is generally cylindrical, as best seen in FIG. 2, which shows an end view of the outlet face 22 of the plate 20, such that the sides of the channel 25 are straight and mutually parallel, and such that the axis of the channel is coaxial with the axis x-x of the sonotrode 11.

The inlet face 21 of the plate 20 is axially spaced from the active face of the sonotrode 11 by a gap approaching 0.35 mm filled with air at atmospheric pressure and at room temperature. The static air pressure produced at the end of the channel 25 nearest to the sonotrode 11 was measured with different lengths of channel 25, while maintaining a consistent axial separation of 0.35 mm from the sonotrode 11. Measurements were taken by inserting a hypodermic needle (0.5 mm diameter) through the channel device (for example into the channel 25) into close proximity to the face of the sonotrode 11, connected by vinyl tubing (which optionally passed through the channel device, for example through the channel 25) to a manometer, always ensuring that the needle was mounted on a linear ball-bearing slide which was fitted with a location stop, so that it could be ensured that successive readings were taken with the needle point in the same position.

Figure 4:
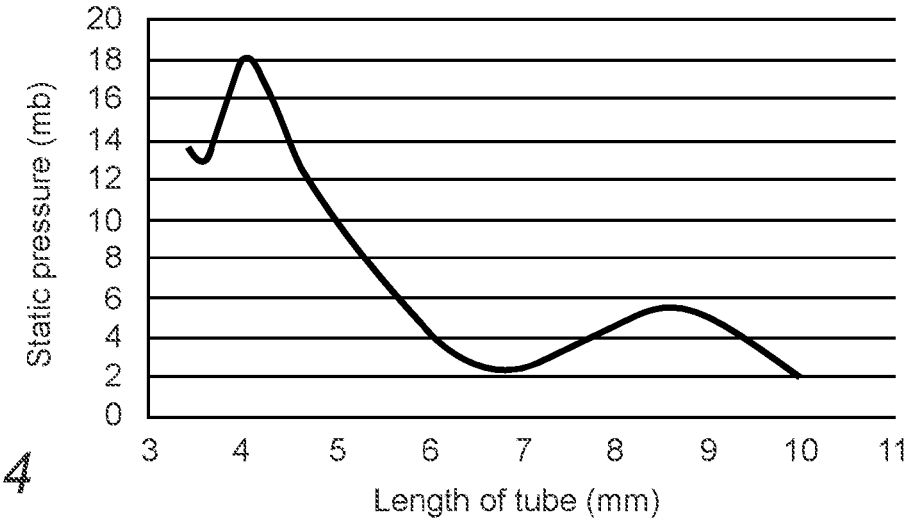
FIG. 4 shows a graph plotting variations of the length of the channel (providing different displacements between the sonotrode active face and the outlet end of the channel) (x-axis) in the atomiser assembly of FIG. 1 against static air pressure obtained at the channel inlet (y-axis) with the different variations.

It was found that a peak static air pressure within the channel occurred when the displacement between the active face of the sonotrode 11 and the outlet face of the channel device was approximately 3.8-4.5 mm, typically approaching 4 mm in channel length. Summing this channel length with the typical separation between the channel inlet and the active face of the sonotrode, this overall value of channel length+separation correlates well with a $1\times(\lambda/4)$ in this example=4.25 mm (since $\lambda$ for 20 kHz in air in this example=17 mm based on the above frequency characteristics of the transducer and the medium of air) as shown in FIG. 4. Accordingly a higher static pressure at the channel inlet was obtained when the displacement approached a value of $n(\lambda/4)$ where n=1. Peaks could also be obtained in this example when n=other odd numbers, e.g. where n=3, 5 etc. Hence, the outlet of the channel device was axially displaced along the axis of the wave at a node on the wave which substantially coincided with the outlet of the channel.

The high static pressure produced by the peak length of channel 25 (resulting in a total displacement between the active face of the sonotrode and the channel outlet of $(\lambda/4)$) is evidence of the formation of a standing wave within the channel 25. Acoustic energy from the sonotrode 11 travels through the channel, and the expansion of the incident wave front from the channel outlet creates a transient interface 26 between low and high impedance established within a transition zone $T_z$ just outside the channel outlet. The incident wave travelling through the channel 25 from the sonotrode 11 therefore reflects back into the channel 25 from the interface 26 as a reflected wave. Choosing a channel length that provides a total displacement of $n(\lambda/4)$ where n is odd (in this example n=1), creates a particularly beneficial reinforcing reflection, hence supporting a standing wave within the channel 25, with a node at or adjacent to the channel outlet. This value of n (n=1) reduces the attenuation effect of the energy wave reducing in intensity as it approaches the channel outlet. Clearly, useful examples of the invention can be reproduced with variations departing from this displacement value, but better results can be obtained closer to the stated value.

The suspension of fluid to be atomised is discharged from the fluid outlet of a fluid delivery device 30 at or near the channel outlet, within the transition zone 26, which is particularly beneficial because at the node formed at the channel outlet, steep pressure gradients exist so that suspension discharged from the fluid delivery device 30 into this part of the wave absorbs large amounts of energy from the incident and reflected waves and is atomised with high efficacy and efficiency. Optionally, the fluid is discharged from the fluid outlet at an axial location with respect to the axis of the channel 25 between the outlet face 22 of the plate 20, and the boundary of the transition zone 26. Optionally the tip of the fluid delivery device 30 can be disposed anywhere in the area 31 adjacent to the boundary of the channel 25. Optionally, a node is formed at the outlet of the channel 25, and the fluid is discharged at or near to the node.

Figure 5:
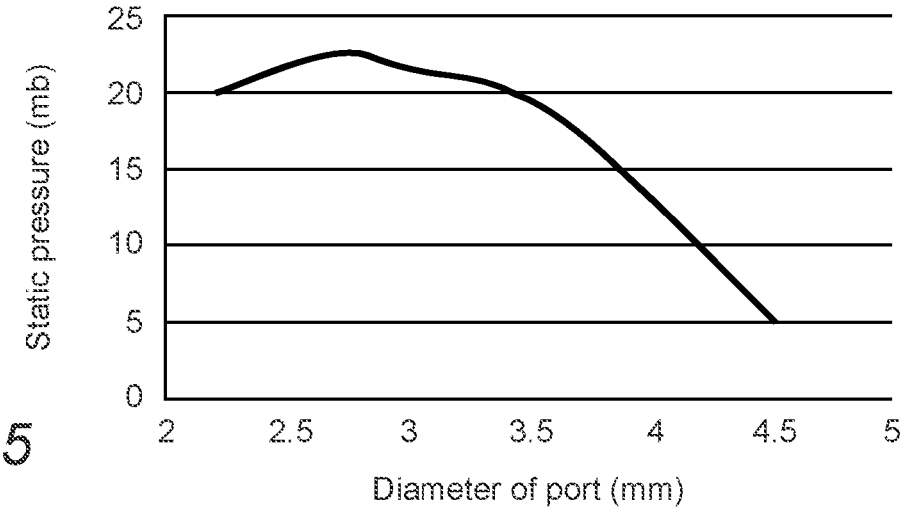
FIG. 5 shows a graph plotting variations of the diameter of the channel (x-axis) in the atomiser assembly of FIG. 1 against static air pressure obtained at the channel inlet (y-axis) with the different variations.

Adjusting the diameter of the channel 25 also has a beneficial effect on the formation of the standing wave inside the channel, as the diameter affects the relative acoustic impedance between the inside of the channel 25 and the outside. A smaller channel gives a greater difference from the absolute acoustic impedance of the unconstrained air outside the channel, but limits the amount of energy that can be transmitted by the energy wave through the channel 25. Further, a small diameter channel causes a more sharply-defined reflection. Larger diameters in the channel reduce the definition of the reflection, but allow more energy transfer by the wave. Hence for suitable examples of atomiser assemblies, a balance needs to be struck between sufficient energy transfer through a large enough diameter of channel, and a sufficiently small diameter of channel in order to create an acoustic impedance gradient to provide a sufficiently definite reflection from the boundary of the transition zone 26. We conducted experiments to estimate the amplitude of the standing wave produced in the channel by measuring the static pressure at the channel inlet with different diameters of channel 25. Our results suggested that there is a practical limit to the ratio of diameter to length of the channel, w=d/l, and that as the reflection forms progressively and from a range of different axial locations, the effective mean point of reflection lies outside of the channel outlet. We found from these results that a reasonably well-defined standing wave can be formed within the channel 25 with good nebulisation effects with the ratio w approaching 0.7. Clearly, a range of values of ratio w on either side of this ratio will also achieve good results, and the experiments showed that good reflection can be achieved in the standing wave in values of ratio w ranging from 0.5-1, particularly 0.6-0.8, as shown in FIG. 5. Hence, with a channel length of 4 mm in this example, the most suitable diameter of channel 25 of the examples studied was obtained when the diameter approached 2.8 mm.

Figure 6:
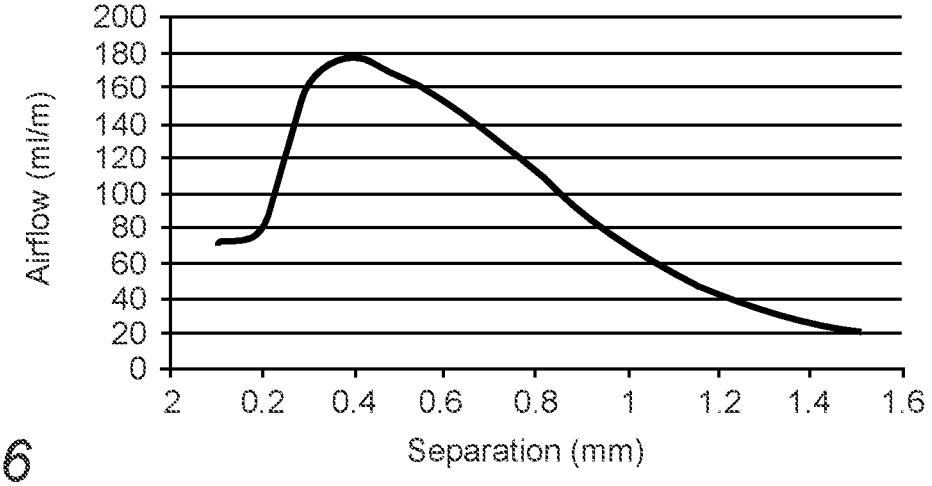
FIG. 6 shows a graph plotting variations of the separation (x-axis) in the atomiser assembly of FIG. 1 between the channel device and the energy generator against airflow obtained at the channel inlet (y-axis) with the different variations.

Adjusting the separation between the channel inlet face 21 and the sonotrode 11 also affected the characteristics of the dispersion formed at the outlet face 22, and particularly could be adjusted in order to affect the direction of travel of the dispersion, and the density of the spray; for example, with a suitable separation between the channel inlet face 21 and the active face of the sonotrode 11, the dispersion could be formed as a relatively tight cone with a relatively defined vector away from the outlet face 22, rather than a diffuse dispersion with little or no definition to any particular vector of movement. We postulate that the proximity of the inlet face 21 to the sonotrode active face gives rise to the formation of a small, positive air pressure because of acoustic radiation pressure effects see references: *Non-contact transportation using near-field acoustic levitation* (Sadayuki Ueha, Yoshiki Hashimoto, Yoshikazu Koike. Ultrasonics 38 (2000) 26-32) and *Acoustic radiation pressure produced by a beam of sound* (Boa-Teh Chu, Robert Apfel. J. Acoust Soc Am. 72(6) (1982) 1673-1687), which are incorporated herein by reference. This pressure gives rise to a flow of air through the channel 25 which causes the dispersion formed at the channel outlet to be discharged in a direction away from the outlet face 22, hence reducing contamination of the face of the sonotrode 11 and the plate 20. The radiation pressure appeared to be independent of the frequency of radiation but shows correlation between the distance between the active face of the sonotrode 11 and the inlet face 21 of the plate 20, and our experiments suggest that a separation approaching 0.35 mm is effective. Other separation values could be useful for gasses of different density as a medium, and references 9 and 10 provide sufficient formulae to enable the determination of other values for other gasses. Clearly, useful examples of the invention can be reproduced with variations departing from this separation value, but our results shown in FIG. 6 plotting the air flow obtained through the channel 25 against separation between the channel inlet face 21 and the active face of the sonotrode 11 indicate that a range of separation values between 0.25 and 0.4 mm in air is capable of achieving a suitable effect directing the spray of the dispersion formed at the channel outlet in a more precise conical configuration, away from the atomiser assembly, and towards any target being coated.

In certain examples of the invention, the assembly produces a more directed spray, forming a cone with a lower angle of divergence from the axis of the channel 25, and a consequentially narrower surface area of coverage. This leads to less waste of sprayed material, and more accurate spraying of the fluid onto the target. Certain examples of the invention may also exhibit reduced susceptibility to clogging, and may more easily spray very viscous liquids. Certain examples of the invention may also be particularly useful for spraying of hazardous or toxic materials, for example asbestos, for laboratory and/or industrial purposes.

Figure 3:
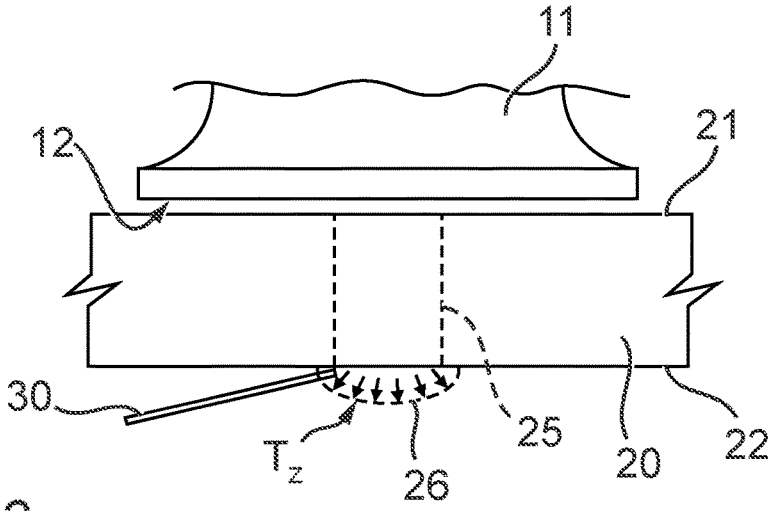
FIG. 3 shows an enlarged side view of the atomiser assembly of FIG. 1, showing a schematic transition zone and impedance gradient between low and high acoustic impedance outside the channel outlet.
Figure 7:
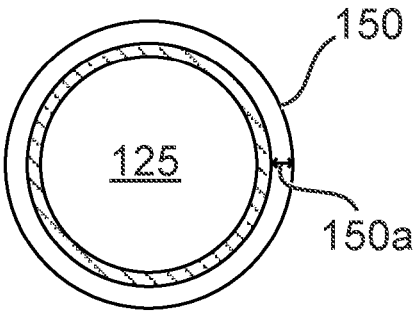
FIG. 7 shows a schematic view of second example of a an atomiser assembly with a channel outlet and the annular space formed around it by the edge of an annular channel, with other parts removed for clarity.
Figure 8:
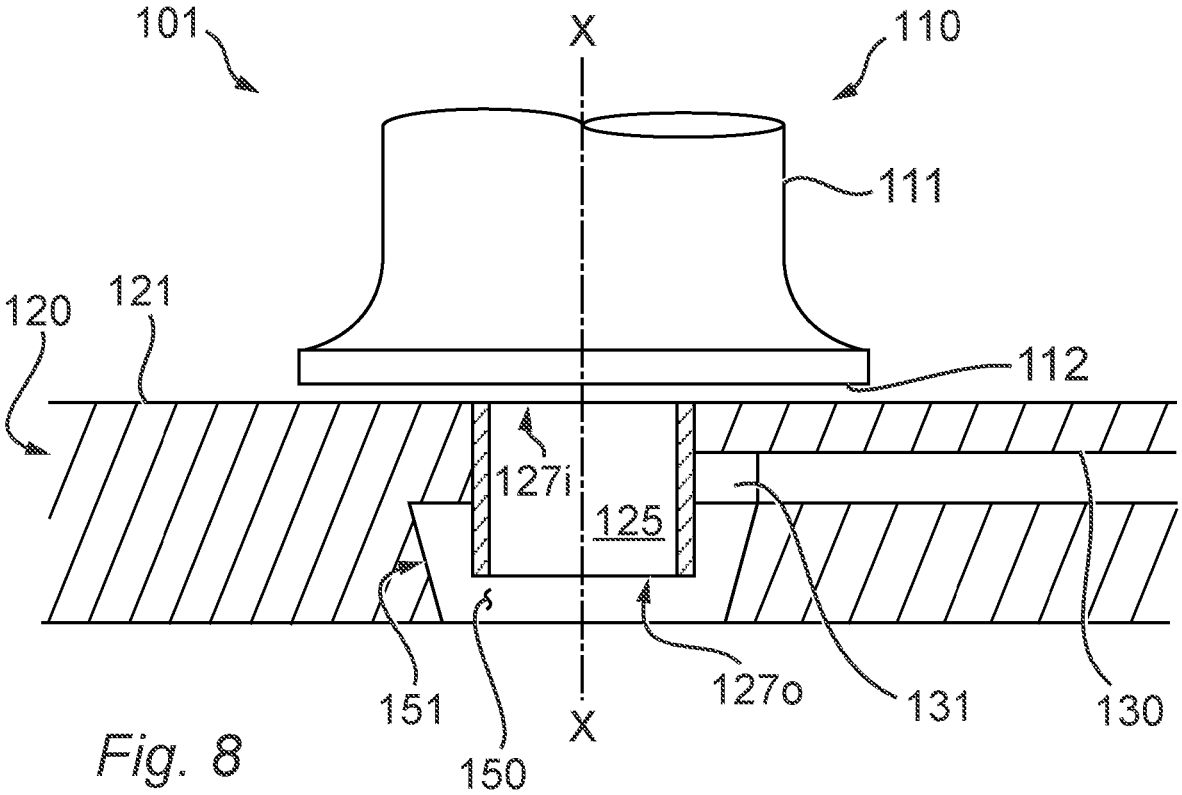
FIG. 8 shows a schematic side view of the FIG. 7 assembly including the sonotrode, channel, annular chamber and fluid delivery device.
Figure 9:
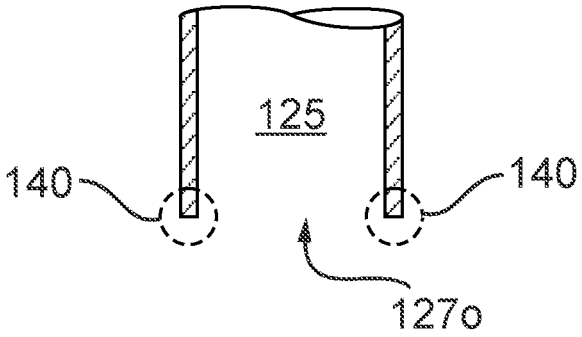
FIG. 9 shows a schematic detail view of the FIG. 8 channel with the low pressure torus at the channel outlet illustrated and other parts removed for clarity.

Another example of the invention is shown in FIGS. 7-9. For conciseness, features that remain the same as described above will not be described in detail again. Similar features to those of the example shown in FIGS. 1-3 will be given the same reference number, increased by 100. Hence, the atomiser assembly 101 of FIGS. 7-9 has an energy generator 110 comprising a sonotrode 111 with an active face 112, and a plate 120 with a channel 125 as described for the previous example.

The active face 112 of the sonotrode 111 is parallel with the channel outlet surface 121 of the plate 120, with a gap approaching 0.35 mm filled with air at atmospheric pressure and at room temperature as described in the first example. The sonotrode 111 emits an ultrasonic energy wave as described before, which sets up a standing wave within the channel 125. As before, acoustic energy emitted by the sonotrode 111 travels through the channel 125. The incident wave front expands from the channel outlet 127*o* and establishes a transient interface between low and high impedance within a transition zone just outside the channel outlet 127*o*. When the displacement of the outlet 127*o* of the channel 125 relative to the active face 112 of the sonotrode 111 approaches an axial length of $n(\lambda/4)$ (where n is an odd number), a particularly beneficial reinforcing reflection of the incident wave back into the channel 125 is created, supporting the standing wave within the channel 125, with a node at or adjacent to the channel outlet 127*o* as before. In this example, the peak static air pressure adjacent to the channel inlet 127*i* was measured (using a manometer provided with a narrow gauge syringe tip as previously described) to be ~30 mbar, and the low pressure region adjacent to the channel outlet 127*o* was measured to be ~−30 mbar. This is sufficient to set up a pressure differential through the channel 125, resulting in the air moving from the high pressure area at the channel inlet 127*i* to the low pressure area at the channel outlet 127*o*, producing a steady positive flow of air through the channel 125.

FIG. 7 shows an end view of the channel 125, with an annular chamber 150 formed in the outlet face of the plate 120, the annular chamber 150 having a tapered wall 151, the inner edge of which defines the chamber 150. There is a small gap 150*a* (see FIG. 7) between the exterior of the channel 125 and the inner edge of the wall 151 of the annular chamber 150, forming an annular outlet of the chamber through which fluid exits the chamber into the energy wave produced by the sonotrode 111.

FIG. 8 shows a schematic side view of the energy generator 110 (not to scale). The sonotrode 111 comprises a flat active face 112 in close proximity to the channel inlet face 121 of the plate 120, as before. The annular chamber 150 extends around the channel 125 and protrudes slightly further than the channel outlet in the axial direction of the channel 125.

FIG. 9 shows a detailed, close-up view of the channel outlet 127*o*, illustrating the toroidal region of low pressure 140 around the outer surface of the wall of the channel outlet 127*o* (not to scale). For clarity, the other parts of the assembly 101 are not illustrated in FIG. 9. The region of low pressure 140 is well-defined, but extremely small relative to the rest of the apparatus.

In FIG. 8, the protruding edges of annular chamber 150 extend beyond the location of this low-pressure torus 140. Having an area of lower pressure 140 within the boundaries of the annular chamber may be advantageous to fluid uptake, as it can encourage the fluid within the chamber 150 to flow towards the low pressure areas 140 at the chamber outlet and into the energy wave at the channel outlet 127*o*. The energy wave then atomises or aerosolises the fluid, and disperses it.

To a greater or lesser extent, the region of low pressure 140 illustrated in the example of FIG. 9 is present in all examples of the invention. The energy wave produced by the sonotrode 11, 111, 211 is reflected back into the channel 25, 125, 225 and as the low-high impedance transition boundary is most abrupt at the outer edges of the channel outlet, the reflection of the wave at this location may contribute to the formation of the low pressure region 140. The low pressure region 140 is well-defined when the displacement between the active face 112 of the sonotrode 111 and the channel outlet 127 approaches $n(\lambda/4)$ where n=1, more so than when n=3, and is not seen where the displacement approaches a multiple of $n(\lambda/4)$ where n is an even number. The low pressure region 140 was easily mapped in various examples by taking pressure readings using a manometer equipped with a syringe tip, and placing the syringe tip at different locations around the outlet of the channel to map the boundaries of the low pressure area.

The fluid delivery device 130 in the form of an injection line for the fluid slurry being atomised is also schematically illustrated in FIG. 8. The fluid enters annular chamber 150 at the injection point 131. The rate of fluid delivery varies according to the viscosity of the fluid being passed through the delivery device 130. Some fluids may be discharged in a slow but steady stream, while others may be dripped into the chamber 150. The angle of the wall 151 of the annular chamber 150, combined with the tendency for the fluid to flow towards the low pressure torus, can act to focus the stream of fluid into the path of the energy wave emitting from the channel 125. The fluid then absorbs large quantities of energy from the wave and is atomised as described above. The fluid may also be drawn through the chamber outlet by capillary action in some examples.

Figure 10:
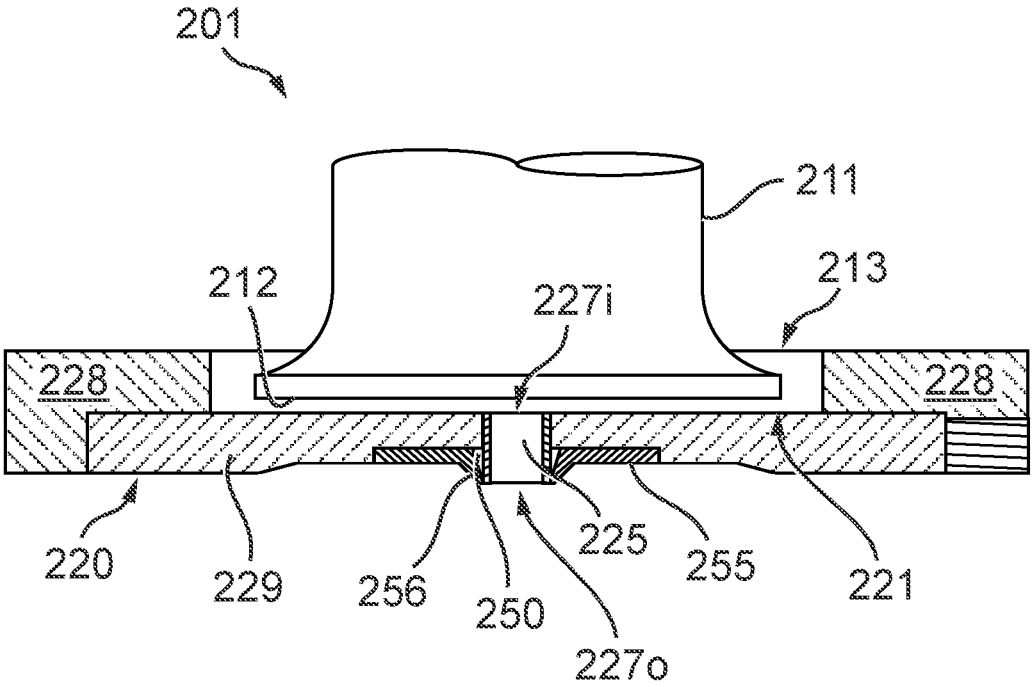
FIG. 10 shows a schematic side view of a third example of an atomiser assembly with the sonotrode end face housed within a recess in the plate, and an annular chamber around the channel.
Figure 11:
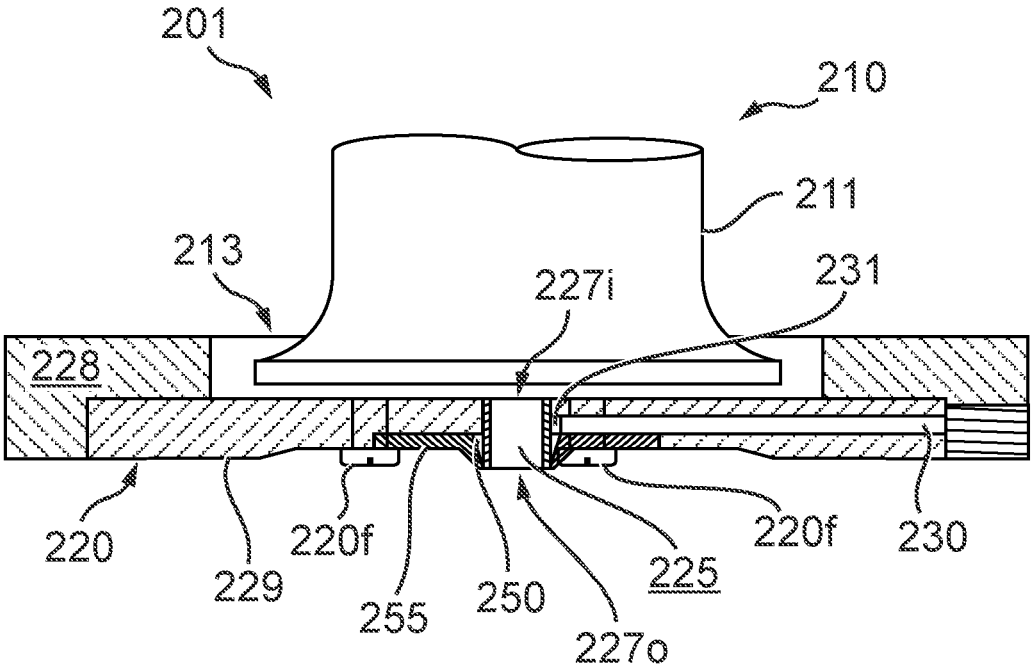
FIG. 11 shows a schematic side view of the assembly of FIG. 10 with the fluid delivery device shown, and the plate comprising different segments connected together.

A third example of the invention is shown in FIGS. 10 and 11. For conciseness, features that remain the same as described in the previous two examples above will not be described in detail again. Similar features to those of the example shown in FIGS. 1-3 and 7-9 will be given the same reference number, increased by 200. Hence, the atomiser assembly 201 of FIGS. 10-11 has an energy generator 210 comprising a sonotrode 211, and a plate 220 with a channel 225 as described for the previous example.

FIG. 10 shows a schematic side view of an example of the invention where the active face 212 of the sonotrode 211 is disposed within a recessed area 213 of the plate 220, with the active face 212 of the sonotrode 211 being parallel to the channel inlet face 221 of the recess 213, and the channel inlet 227*i*. The gap between the active face 212 of the sonotrode 211 approaches 0.35 mm, and is filled with air at atmospheric pressure and at room temperature as described in the first two examples. As before, the sonotrode 211 emits an ultrasonic wave, the wave front creating a transient interface between low and high impedance, where the interface acts to reflect the incident wave back into the channel 225. As before, the reflection is reinforced when the displacement of the outlet of the channel 225 relative to the active face 212 of the sonotrode 211 approaches an axial length of $n(\lambda/4)$ (where n is an odd number), supporting the standing wave within the channel 225, with a node at or adjacent to the channel outlet 227*o* as before.

When the tapered section 255 is fitted over the channel 225, it forms the annular chamber 250. A region of low pressure is set up at the channel outlet 227*o*, as illustrated generally in FIG. 9. As before, as the air surrounding the apparatus is at a higher pressure than the region of low pressure, it flows towards the low-pressure torus and is carried forwards by its own inertia into the stream of air moving from the high pressure region adjacent to the channel inlet 227*i* towards the low pressure torus around the exterior of the channel outlet 227*o*.

The external profile 256 of the tapered section 255 has a tapered external diameter that decreases in an axial direction, away from the sonotrode 111. Experimental measurements of the velocity of air flowing towards the region of low pressure show the velocity is increased when the channel outlet has a tapered external profile. The air flows over (and is focussed by) the tapered profile 256, towards the low pressure region, and is, we believe, carried through the low pressure region by inertial forces. As the air passes through the torus, it is entrained in the stream of air flowing from the channel outlet 227*o* as a result of the pressure differential between the channel inlet and outlet, and forms a powerful jet.

By changing the angle of the external profile 256, it is possible to alter the power of the air jet. For example, removing the taper altogether so that the outer face of the plate 220 is flush with the channel outlet 227 substantially reduces the air jet effect.

In some examples, the powerful jet effect can be minimised by using a non-tapered external profile with the surface of the plate at the channel outlet being perpendicular to and flush with the channel outlet (for example, as schematically drawn in FIG. 3), and optionally in or near the same plane as the channel outlet. Provided that the spacing between the active face of the sonotrode and the channel outlet is very close or equal to $n(\lambda/4)$ (where n is an odd number), the torus of low pressure continues to be formed around the exterior of the channel outlet. The jet effect is then reduced, we believe, by the flow of air being drawn to the torus from all directions. The air is not focussed in any given direction, and may therefore meet and combine to reduce or cancel out the velocity of air being drawn in from opposing directions.

The plate 220 is formed from segments of the same or optionally different materials. The outer segment 228 is in this example a single annular-shaped piece, which fits over the inner section 229 of the plate 220. In this example, the fitting is a bayonet-style fitting. Inner segment 228 comprises an L-slot (but a J-slot or similar would also be suitable). A further annular-shaped segment (not shown), comprising protrusions adapted to fit into the corresponding slot in inner segment 228, then fits over the outwardly-facing end of inner segment 228 to hold the segmented plate 220 together.

FIG. 11 shows the apparatus of FIG. 10, with the fluid delivery device 230 illustrated, and threaded fixings in the form of bolts 220*f* shown as one example of a means of fixing the tapered section 255 to the inner plate section 229.

The following disclosures are incorporated herein by reference:

1. The mechanisms of the formation of fogs by ultrasonic waves. Sollner K. Trans Faraday Soc 32 (1936) 1537-1538
2. Ultrasonic atomization of liquids. Peskin R L, Raco R J. J. Acoust Soc Am 35 (1963) 1378-1381
3. Radiation Pressure—the history of a mislabelled tensor. Beyer, R T. J. Acoust Soc Am 63(4) (1978) 1025-1030.
4. Ultrasonic separation of suspended particles. Part 1—Fundamentals. Groschl M. Acustica Acta Acustica 84 (1998) 432-447
5. US Patent 20070017441 A1 (2007)
6. Inverter topologies for ultrasonic piezoelectric transducers with high mechanical Q-factor. Kauczor C, Frohleke N. IEEE Power Electronics Specialists Conference. IEEE 35$^{th}$ Annual (2004) 4, 2736-2741
7. Production of fine particles from melts of metals or highly viscous fluids by Ultrasonic Standing Wave Atomisation. Anderson O, Hansmann S, Bauckhage K. Particle and Particle Systems Characterisation 13 (1996) 217-223
8. Modelling and simulation of the disintegration process in Ultrasonic Standing Wave Atomisation. Reipschlager O, Bothe H-J, Warnecke B, Monien B, Pruss J, Weigand B. University of Paderborn. ILASS-Europe 2002.
9. Non-Contact transportation using near-field acoustic levitation. Sadayuki Ueha, Yoshiki Hashimoto, Yoshikazu Koike. Ultrasonics 38 (2000) 26-32
10. Acoustic radiation pressure produced by a beam of sound. Boa-Teh Chu, Robert Apfel. J. Acoust Soc Am. 72(6) (1982) 1673-1687

The invention claimed is:

1. A method of spray drying a particulate substance from a slurry of the particulate substance suspended in a fluid, the method comprising generating a dispersion of particles from the slurry using an atomiser device, the atomiser device comprising an energy generator having an active face, a channel device having a channel comprising a bore extending parallel to an axis of the channel, with a channel inlet and a channel outlet, wherein the channel device comprises a plate having opposite inlet and outlet surfaces on which the channel inlet and channel outlet are respectively disposed, and wherein the channel is filled by a gas, and a fluid delivery device having a fluid outlet, the method comprising:

separating the inlet surface of the plate from the active face of the energy generator by a gap filled with a gas;

generating an energy wave from the energy generator;

passing the energy wave generated by the energy generator into the channel inlet and through the bore of the channel and emitting the energy wave from the channel outlet, wherein the energy wave has a frequency selected from the range of frequencies consisting of 20 kHz to 70 kHz;

establishing a standing wave in the energy wave within the channel;

axially separating the channel outlet from the energy generator by a distance;

flowing the fluid through the fluid delivery device, and discharging the fluid from the fluid outlet into the energy wave emitted from the channel outlet;

the method including flowing the gas from the channel inlet to the channel outlet, and establishing the standing wave in the gas, and drying the dispersion of particles.

2. The method of claim 1, including axially separating the channel inlet from the active face of the energy generator by a distance ranging from 0.1 mm to 0.35 mm.

3. The method of claim 1, including discharging the fluid from the fluid outlet at an axial location with respect to the axis of the channel corresponding to a pressure node on the energy wave.

4. The method of claim 1, including discharging the fluid from the fluid outlet within a transition zone formed outside the channel outlet, the transition zone having an acoustic impedance gradient at the interface between the interior of the channel and the exterior of the channel, and wherein the method includes reflecting the incident energy wave from the acoustic impedance gradient within the channel and towards the energy generator.

5. The method of claim 1, including flowing the fluid into a torus-shaped region of low pressure outside the channel outlet.

6. The method of claim 1, including discharging the fluid from the fluid outlet of the fluid delivery device into an annular chamber surrounding the channel outlet, and flowing the fluid from the annular chamber past the channel outlet.

7. The method of claim 6, wherein the annular chamber extends beyond the channel outlet in an axial direction with respect to the channel, and wherein the outlet of the fluid delivery device is disposed within the annular chamber surrounding the channel outlet.

8. The method of claim 7, wherein the annular chamber comprises a wall, and wherein the wall of the annular chamber extends beyond the channel outlet in an axial direction with respect to the channel by a distance in the range of 0.1-0.3 mm.

9. The method of claim 8, wherein the wall of the annular chamber tapers towards the channel outlet such that the radius of the annular chamber decreases along the axis of the channel in a direction towards the outlet surface of the channel device.

10. The method of claim 1, including propagating the energy wave within the channel in a direction aligned with the axis of the channel.

11. The method of claim 1, wherein the diameter to length ratio of the channel is selected from a range of 0.5 to 0.8.

12. The method of claim 1, wherein the energy wave is an ultrasound wave.

13. A method of spray drying a particulate substance from a slurry of the particulate substance suspended in a fluid, the method comprising generating a dispersion of particles from the slurry using an atomiser device, the atomiser device comprising an energy generator having an active face, a channel device having a channel comprising a bore extending parallel to an axis of the channel, with a channel inlet and a channel outlet, wherein the channel device comprises a plate having opposite inlet and outlet surfaces on which the channel inlet and channel outlet are respectively disposed, and wherein the channel is filled by a gas, and a fluid delivery device having a fluid outlet, the method comprising:

separating the inlet surface of the plate from the active face of the energy generator by a gap of 0.1 mm to 0.35 mm, the gap being filled with a gas;

generating an energy wave from the energy generator;

passing the energy wave generated by the energy generator into the channel inlet and through the bore of the channel and emitting the energy wave from the channel outlet, wherein the energy wave has a frequency selected from the range of frequencies consisting of 20 kHz to 70 kHz;

establishing a standing wave in the energy wave within the channel;

axially separating the channel outlet from the energy generator by a distance;

flowing the fluid through the fluid delivery device, and discharging the fluid from the fluid outlet into a transition zone of the energy wave formed outside the channel outlet, the transition zone having an acoustic impedance gradient at the interface between the interior of the channel and the exterior of the channel;

reflecting the incident energy wave back into the channel towards the energy generator from the acoustic impedance gradient in the transition zone; and drying the dispersion of particles.

14. The method of claim 13, including discharging fluid from the fluid outlet at an axial location with respect to the axis of the channel corresponding to a pressure node on the energy wave.

15. The method of claim 13, wherein the transition zone comprises a torus-shaped region of low pressure outside the channel outlet.

16. The method of claim 13, including discharging the fluid from the fluid outlet of the fluid delivery device into an annular chamber surrounding the channel outlet, and flowing the fluid from the annular chamber past the channel outlet.

17. The method of claim 16, wherein the annular chamber extends beyond the channel outlet in an axial direction with respect to the channel, and wherein the outlet of the fluid delivery device is disposed within the annular chamber surrounding the channel outlet.

18. The method of claim 17, wherein the annular chamber comprises a wall, and wherein the wall of the annular chamber extends beyond the channel outlet in an axial direction with respect to the channel by a distance in the range of 0.1-0.3 mm.

19. The method of claim 18, wherein the wall of the annular chamber tapers towards the channel outlet such that the radius of the annular chamber decreases along the axis of the channel in a direction towards the outlet surface of the channel device.

* * * * *